US006659035B2

(12) United States Patent
Treytiak

(10) Patent No.: US 6,659,035 B2
(45) Date of Patent: Dec. 9, 2003

(54) BOAT COVER

(76) Inventor: William Treytiak, 71 Lakeview Cove, Winnipeg Manitoba (CA)

( * ) Notice: Subject to any disclaimer, the term of this patent is extended or adjusted under 35 U.S.C. 154(b) by 0 days.

(21) Appl. No.: 10/189,513

(22) Filed: Jul. 8, 2002

(65) Prior Publication Data

US 2003/0010273 A1 Jan. 16, 2003

Related U.S. Application Data

(60) Provisional application No. 60/304,097, filed on Jul. 11, 2001.

(51) Int. Cl.[7] ..... B63B 17/00

(52) U.S. Cl. ..... 114/361; 150/166; 296/100

(58) Field of Search ..... 114/361; 150/166, 150/154; 296/100

(56) References Cited

U.S. PATENT DOCUMENTS

| | | | | |
|---|---|---|---|---|
| 4,671,203 A | * | 6/1987 | Sanburg | 114/361 |
| 5,228,408 A | | 7/1993 | Jannausch | |
| 5,396,861 A | | 3/1995 | Acker et al. | |
| 5,632,223 A | | 5/1997 | Bray et al. | |
| 5,706,753 A | | 1/1998 | Menne et al. | |
| 5,809,929 A | | 9/1998 | Garnes | |

* cited by examiner

*Primary Examiner*—Jesus D. Sotelo
(74) *Attorney, Agent, or Firm*—Michael R. Williams; Ryan W. Dupuis; Adrian D. Battison

(57) ABSTRACT

A two-piece boat cover for use with open fishing boats as well as boats with a single console or double console is described.

6 Claims, 2 Drawing Sheets

BOAT COVER

PRIOR APPLICATION

This application claims priority under 35 USC §119(e) to U.S. Ser. No. 60/304,097, filed Jul. 11, 2001.

FIELD OF THE INVENTION

The present invention relates generally to the field of cover systems for aquatic craft.

BACKGROUND OF THE INVENTION

Covering a boat when not in use reduces the amount of dirt that gathers in the boat and also protects the interior of the boat from the elements, for example, sun, rain and wind. In addition, when a boat is towed, placing a cover thereon improves wind resistance of the boat, thereby improving gas mileage. It is of note that the cover also allows the storage of equipment and other articles within the covered boat.

However, the boat covers taught by the prior art are typically either cumbersome and/or unwieldy to use or install.

U.S. Pat. No. 5,809,929 teaches a custom-made plexiglass cover which is composed of four parts. In order to mount this cover, however, holes must be drilled around the boat's gunwale.

U.S. Pat. Nos. 5,706,753 and 5,396,861 both teach systems for fastening a cover to a boat, but do not teach specific boat covers for use therewith.

Clearly, an improved boat cover is needed which is easy to use, relatively inexpensive and can be fitted onto the boat without exposing the user to potential injury.

SUMMARY OF THE INVENTION

According to a first aspect of the invention, there is provided a boat cover for use with a boat, said boat having a bow, a stern and sides, said boat cover comprising:

a bow portion fitted over the bow of the boat;

a stern portion fitted over the stern of the boat; and zipper means for connecting the bow portion and the stern portion.

DESCRIPTION OF THE PREFERRED EMBODIMENTS

Figure 1:
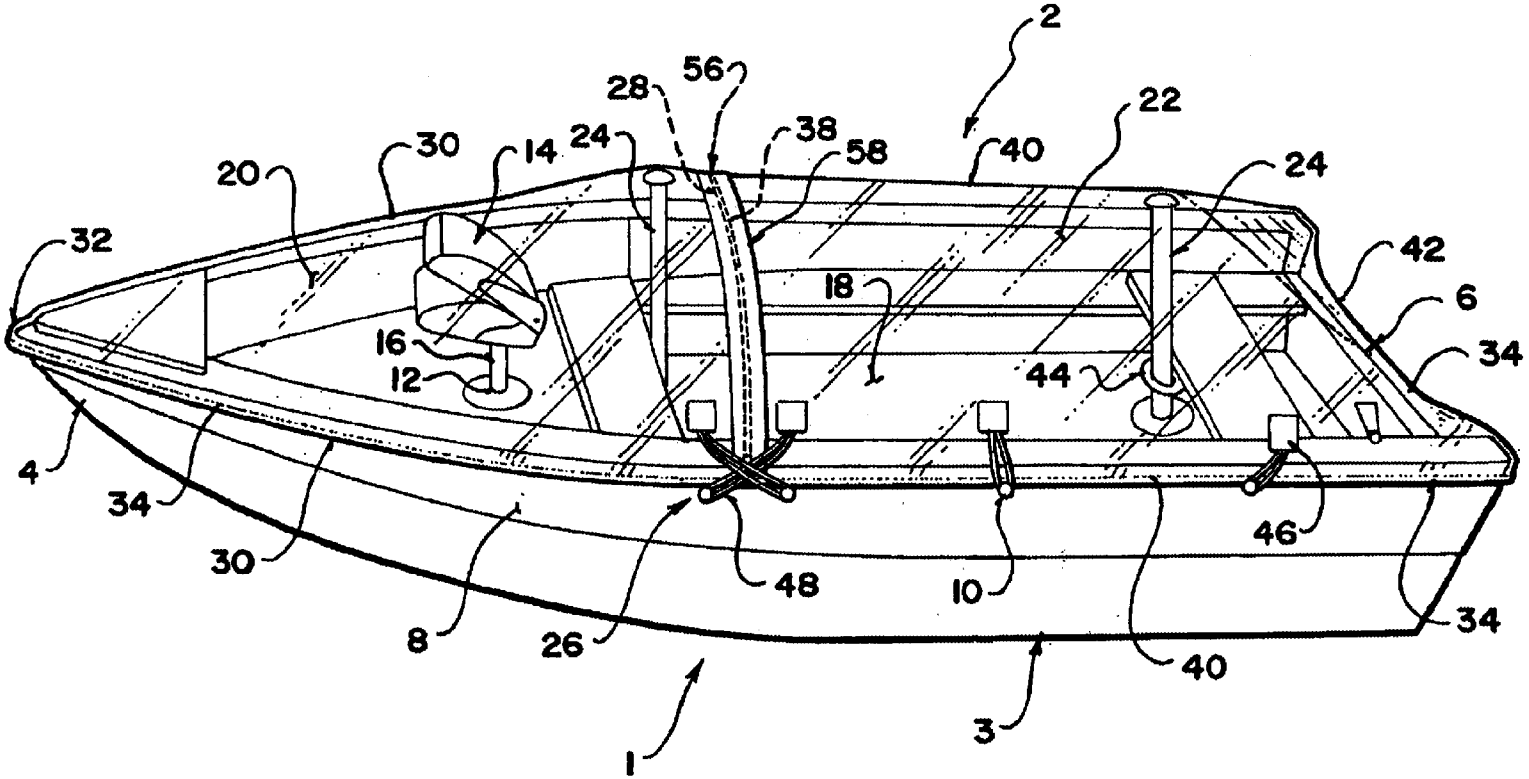
FIG. 1 is a side elevation view of the boat cover.

As will be appreciated by one knowledgeable in the art, the size, shape, dimensions and style of boats varies greatly; however, as discussed below, the invention is not limited to a specific style of boat and the figures are for illustrative purposes only.

Described herein is a two-piece boat cover arranged, as described below, so that a boat or other aquatic craft can be covered while the individual is within the craft, thereby reducing risk of injury or accident.

Referring to the drawings, a boat 1 generally comprises a hull 3, a bow 4, a stern 6, sides 8, stayput fasteners 10, at least one socket 12 for mounting a seat 14 having a stem 16 thereon and a floor 18.

A boat cover 2 comprises a bow portion 20, a stern portion 22, at least one support post 24 and connectors 26. The boat cover 2 is a two piece mooring cover for open fishing boats as well as those boats with a single console or double console.

Figure 2:
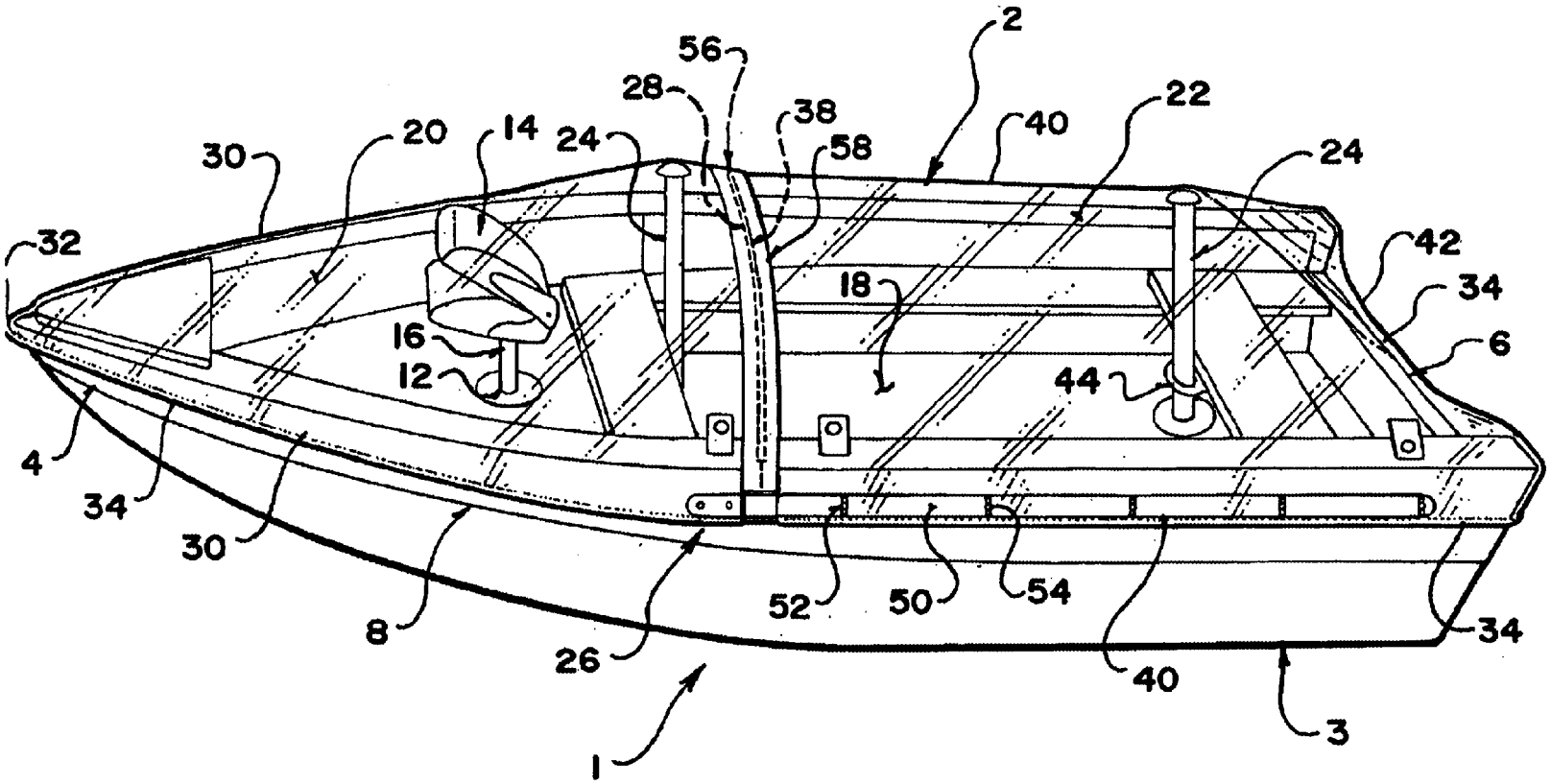
FIG. 2 is a side elevation view of the boat cover having an alternative connector arrangement.

In the embodiment shown in FIGS. 1 and 2, the bow portion 20 comprises a bow zipper 28 and two sides 30. In this embodiment, the bow zipper 28 connects the two sides 30 and the two sides 30 extend therefrom at angles to meet at a point 32 for fitting over the bow 4 of the boat 1, as discussed below. As will be appreciated by one knowledgeable in the art, the size and shape of the bow portion 20 will vary according to the layout of the boat 1, as discussed below. The sides 30 include elastics 34 within the edges thereof for engaging the sides 8 of the boat 1, as described below.

The stern section 22 comprises a stern zipper 38 extending between two sides 40 and a rear portion 42 opposite the stern zipper 38. The two sides 40 and the rear portion 42 include elastics 34 within the edges thereof for engaging the sides 8 of the boat 1, as described below. It is of note that in some embodiments, the rear portion 42 of the stern section 22 is arranged to be fitted around a motor whereas in other embodiments, the rear portion 42 is arranged to be fitted over a motor. Alternatively, the boat cover 2 may include a separate motor cover.

The support post 24 includes a spring loaded ring 44 for holding the support post 24 in place. The spring loaded ring 44 may be mounted to, for example, a seat support. It is of note that the underside of the bow portion 20 and/or the stern portion 22 may include a loop for attaching the boat cover 2 to the support posts 24, as described below.

In the embodiment shown in FIG. 1, the connectors 26 comprise bungee loops 48 mounted onto the sides 30 and 40 and, in some embodiments, the rear portion 42.

In the embodiment shown in FIG. 2, the connectors 26 comprise a moulding 50 mounted onto the sides 8 of the boat, the moulding 50 having slidable snaps 52 mounted thereon. In these embodiments, the sides 30 and 40 and in some embodiments the rear portion 42, include snaps 54 for engaging the slidable snaps 52, as described below.

As will be appreciated by one knowledgeable in the art, the boat cover 2, as is the case with all similar products, will tend to shrink over time. As a consequence, the connectors 26 have been designed to be flexible enough to compensate for shrinkage. That is, in one embodiment, the slidable snaps 52 can be moved upwards relative to the moulding 50 or in the other embodiment, the bungee loops 48 can be stretched to compensate for boat cover 2 shrinkage.

In other embodiments, there may be additional connectors 26 in the bow section, approximately half-way from the bow 4 to the bow zipper 28.

In yet other embodiments, the boat cover 2 includes clips for hanging bumper buoys therefrom to protect the boat as well as the connectors 26 from the dock. In some embodiments, the clips are placed one on each side end flap, approximately 6 to 8 inches above the gunnel line as well as one on each side of the boat cover 2 located above the connector on the rear part of the boat cover 2.

It is of note that other suitable connectors known in the art may also be used with the boat cover 2.

In use, the boat cover 2 is fitted over the boat 1 as follows. The bow portion 20 is fitted over the bow 4 of the boat 1 such that the point 32 engages the bow 4. The bow portion 20 is fitted over the support post 24 and, as discussed above, a loop on the underside of the bow portion 20 is fitted over the support post 24 so as to secure the bow portion 20 to the support post 24. The bow section 20 is then pulled toward the stern 6 of the boat 1 such that the elastics 34 in the sides 30 of the bow section 20 engage the sides 8 of the boat 1 so that the bow portion 22 substantially extends over and covers the bow 4 portion of the boat 1. It is of note that this is done while the individual is within the boat 1.

Next, the stern portion 22 is fitted over the stern 6 of the boat 1 such that the rear portion 42 covers the stern of the boat. The stern portion 22 is fitted over the support post 24 and, as discussed above, a loop on the underside of the stern portion 22 is fitted over the support post 24 so as to secure the stern portion 22 to the support post 24. It is of note that the stern portion 22 is fitted onto the boat 1 such that the elastics 34 in the sides 40 and rear portion 42 engage the sides 8 and the stern 6 of the boat 1. Thus, the stern portion 22 extends over and covers the stern portion of the boat 1.

In some embodiments, the boat cover 2 is arranged to have a reinforced circle of vinyl to be fitted over the support post 24 when engaged to cover the boat 1. In these embodiments, the boat cover 2 may include a plastic cap arranged to be fitted onto the support post 24, said cap including means for connecting the cap to the vinyl, for example, at least one snap or the like. In these embodiments, the snap keeps the boat cover 2 in place while it is being connected to the stayputs on the side of the boat, as described below.

The bow zipper 28 and the stern zipper 38 are then engaged, forming a zipper 56. It is of note that securing the bow portion 20 and the stern portion 22 to the posts 24 holds the bow portion 20 and the stern portion 22 in place during zipper 56 formation. In some embodiments, the bow zipper 28 and the stern zipper 38 form two zippers 56 which close from the middle outward for enclosing the boat 1. As a result of this arrangement, the individual can engage one of the zippers 56 and then step out of the boat 1 to close the other zipper 56. The boat cover 2 also includes a flap 58 which is arranged to cover the zipper(s) 56, thereby shielding the zipper 56 from the elements. In some embodiments, the flap 58 includes a Velcro™ strip, snaps or the like for securing an edge of the flap 58 to the boat cover.

In some embodiments, the boat cover 2 includes a second flap sewn underneath the zippers 28 and 38. As will be apparent to one of skill in the art, this second flap keeps water out while also preventing scratching of the boat by the zipper 56 when the boat cover 2 is engaged.

In the embodiment shown in FIG. 1, the bungee loops 48 are fitted over the stayput fasteners 10. As can be seen in FIG. 1, in some embodiments, the bungee loops 48 proximal to the bow zipper 28 and the stern zipper 38 are crossed, thereby further securing the boat cover 2 onto the boat 1. In the embodiment shown in FIG. 2, the slidable snaps 52 on the mounting 50 are positioned such that the snaps 54 on the bow portion 20 and the stern portion 22 can be engaged.

Once assembled, the boat cover 2 protects the boat 1 from rain, wind and sun damage. As discussed above, the boat cover 2 is arranged such that the boat cover 2 can be assembled while the individual is within the boat, thereby reducing the risk of accident or injury.

It is of note that while the boat cover 2 is intended for use while the boat 1 is moored, the boat cover 2 can also be used while the boat 1 is in transit or even in use. Specifically, in these embodiments, the bow portion 22 is fitted over the bow 4 of the boat 1 as discussed above. As a result of this arrangement, the bow 4 of the boat 1 is shielded from the elements and can be used for protected storage.

In some embodiments for use with boats having either a single console or double console, the bow portion 22 and the stern portion 24 may be arranged such that the zipper 56 is proximal to the console for operating the boat 1. In these embodiments, the zipper 56 may be disengaged into the bow zipper 28 and the stern zipper 38, thereby allowing access to the console so that the boat 1 may be operated without removing the boat cover 2. In these embodiments, the boat cover 2 may include an additional zipper perpendicular to the zipper 56 for opening the boat cover 2 and accessing the seat 14 proximal to the console.

In other embodiments, the boat cover 2 may include a plurality of "tie-down" straps for securing the boat cover 2 to a trailer when trailering. In these embodiments, the tie-down straps may be composed of nylon and may be arranged on the boat cover at for example 24–30 inch intervals along the length of the boat cover 2.

It is of note that the above-described boat cover 2 may also be used on boats with solid windshields. In these embodiments, the front part of the cover is arranged to extend from the tip of the bow to approximately 6 inches past the windshield, as well as over the sides of the boat. Stayput fasteners are arranged on the side of the boat proximal to or at the end of the windshield. The zippers are installed at an angle from the center of the windshield to the end of the windshield, or in an "arc" fashion. The portion of the boat cover that rests on the windshield may be reinforced with vinyl and/or may include snaps for connecting the boat cover 2 to the snaps present on the windshield. It is of note that in these embodiments, the rear support post would be installed in the back of the boat where feasible.

It is of note that the above-described boat cover 2 can also be used on fibreglass boats with solid windshields. As will be apparent to one of skill in the art, the boat cover 2 will have the added benefit in these embodiments of protecting the fibreglass sections of the boat from the sun, which would be exposed if prior art covers were engaged. Specifically, many prior art covers are made to cover only the openings of the boat such as the front bow and the sitting area behind the windshield, which is not the case with the boat cover 2 described herein.

It is of note that due to the design of some fibreglass boats, it would be necessary to use "pop-up" round cleats to secure the cover to the side of the boat.

It is of note that in some embodiments, the boat cover 2 may be in the form of a kit, comprising a bow portion 20, a stern portion 22, at least one support post 24, connectors 26 and instructions for assembling the boat cover 2 and for engaging the boat cover 2 onto the boat.

In yet other embodiments, there is provided a boat cover 2 and a boat on which the cover 2 is mounted. The boat has a bow, a stern and sides, and the boat cover comprises a bow portion fitted over the bow of the boat; a stern portion fitted over the stern of the boat; and zipper means for connecting the bow portion and the stern portion.

While the preferred embodiments of the invention have been described above, it will be recognized and understood that various modifications may be made therein, and the appended claims are intended to cover all such modifications which may fall within the spirit and scope of the invention.

What is claimed is:

1. A combination comprising:

a boat having a hull, a bow, a stern and sides having an outer surface; and a boat cover comprising:

a bow portion comprising:

a bow zipper;

sides extending from the zipper and meeting at a point, said point fitted over the bow of the boat;

elastics within the edges of the sides of the bow portion, said elastics engaging the outer surface of the sides of the boat so that the bow portion substantially extends over and covers the bow of the boat; and a stern portion comprising:

a stern zipper;

sides extending from the stern zipper;

elastics within the edges of the sides of the stern portion, said elastics engaging the outer surface of the sides of the boat so that the stern portion substantially extends over and covers the stern of the boat; and wherein the stern zipper is engaged with the bow zipper and secures the bow portion to the stern portion so that the boat cover protects the interior of the boat from rain, wind and sun damage.

2. The combination according to claim 1 including a support post inserted into a seat socket, said support post supporting the boat cover above the hull of the boat.

3. The combination according to claim 1 wherein the boat cover includes at least one loop for connecting the boat cover to the support post.

4. The combination according to claim 1 wherein the boat cover includes stayput fasteners for securing the boat cover to the boat.

5. The combination according to claim 1 wherein the boat cover includes tie-down straps for securing the boat cover to a trailer when the boat is on a trailer.

6. The combination according to claim 1 wherein the boat cover includes at least one flap for covering the zipper means.

* * * * *